US009855581B1

(12) United States Patent
Kim

(10) Patent No.: US 9,855,581 B1
(45) Date of Patent: Jan. 2, 2018

(54) DISPENSING DEVICE AND METHOD OF DISPENSING CONTENTS FROM A POUCH

(71) Applicant: Dae Sik Kim, Newton, MD (US)

(72) Inventor: Dae Sik Kim, Newton, MD (US)

( * ) Notice: Subject to any disclaimer, the term of this patent is extended or adjusted under 35 U.S.C. 154(b) by 0 days.

(21) Appl. No.: 15/294,755

(22) Filed: Oct. 16, 2016

(51) Int. Cl.
*B05C 17/005* (2006.01)
*B65D 47/36* (2006.01)

(52) U.S. Cl.
CPC .. *B05C 17/00583* (2013.01); *B05C 17/00523* (2013.01); *B65D 47/36* (2013.01)

(58) Field of Classification Search
CPC ..... B05C 17/00583; B05C 17/00523; B65D 47/36
USPC ..... 222/146.2, 105, 95, 96, 103
See application file for complete search history.

(56) References Cited

U.S. PATENT DOCUMENTS 1,242,165 A * 10/1917 Fitzgerald ..... B65D 35/28 169/35
4,711,373 A 12/1987 Christine
4,756,450 A * 7/1988 Negaty-Hindi ..... B67D 3/00 222/105
5,323,931 A 6/1994 Robards, Jr.
5,417,347 A 5/1995 de Laforcade
5,544,787 A * 8/1996 Malofsky ..... B05C 17/00546 219/759
5,884,814 A * 3/1999 Nelson ..... F28D 1/06 222/105
6,345,734 B2 2/2002 Schalow
7,617,952 B2 * 11/2009 Saleh ..... A47K 5/1202 222/103
9,314,813 B2 4/2016 Pritchard
2006/0086752 A1 4/2006 Duquet

* cited by examiner

*Primary Examiner* — Donnell Long
(74) *Attorney, Agent, or Firm* — Intrinsic Law Corp.

(57) ABSTRACT

A device for and method of using the device to dispense pourable material from one or more pouches is provided. The device comprises a pair of hinged plates between which one or more pouches can be positioned. The plates of the device are joined by a ratcheting element that secure the plates and any pouches positioned between them. When a squeezing force is applied to the plates, the plates exert pressure upon the one or more pouches to cause the contents of the pouch(es) to be expelled. The ratcheting element is adapted to adjust automatically in response to the force exerted upon the plates. A device adapted to heat and dispense the contents of the one or more pouches is also provided.

13 Claims, 6 Drawing Sheets

DISPENSING DEVICE AND METHOD OF DISPENSING CONTENTS FROM A POUCH

CROSS REFERENCE TO RELATED APPLICATIONS

Not Applicable

FEDERALLY SPONSORED RESEARCH OR DEVELOPMENT

Not Applicable

NAMES OF PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

PRIOR DISCLOSURES BY THE INVENTOR

Not Applicable

BACKGROUND OF THE INVENTION

This invention relates generally to a device for and method of dispensing pourable material from one or more pouches, each pouch having one or more acute or right-angled corners that can be removed to form a dispensing spout.

A simple and economical means of packaging pourable discrete solid particles, a liquid, or mixture thereof is to seal such materials between two flexible sheets to form what is known as a pillow or flat pack pouch. This type of pouch is easy to fill, provides a flat surface area for printing, and can be readily packaged in a box or other rigid container for added protection and shipping.

Although flat pack pouches are widely used in the construction industry to pack cement, sand, and pre-mixed concrete, and in the food industry to pack sugar, flour, bulk soup, and condiments, other consumer products such as lotions, sanitizers, and paints are not sold in flat pack pouches because the availability of economical or universal dispensers adapted for use with such pouches is limited. Indeed, many consumer products are commonly sold in bottles with pump dispensers while other previously described dispensers are compatible only with those pouches that have been modified by the addition of fitments, integrated spouts, or other sealing mechanisms. Such modifications increase the cost of packaging and limit how the dispensers and pouches can be used. Thus, it would be advantageous to provide an economical and user-friendly dispensing system that can be used in the home or in an industrial or commercial setting to dispense a variety of pourable materials directly from unmodified flat pack pouches.

SUMMARY OF THE INVENTION

This invention overcomes some of the limitations of previously described dispensers and systems by providing a simple mechanical device that allows the user to employ multiple strategies to dispense, heat, and mix, or some combination thereof, a liquid of any viscosity. With this invention, the user can place one or more pouches in the desired orientation, dispense almost the entire contents of the pouch(es), selectively heat a pouch, and re-seal the pouch(es), all while generating minimal waste.

Advantageously, this dispensing device can be modified to handle any size of pouch with little to no change in tooling. When the size of a pouch is optimized for its intended end-use, any penalty associated with the higher surface-to-volume ratio of a smaller-sized pouch becomes less of a concern when consideration is given to the cost, effort, and detrimental environmental effects that are associated with cleaning or otherwise preparing a container for re-use.

Another advantage of this dispensing system is that it prevents the contents from being exposed to the air from the time the pouch is filled until the user completes the task for which the pouch is needed. Although this invention may be used in any number of industries including, but not limited to, the building supply, health care, coatings, and personal care product industries, it was originally developed for the carrying and dispensing of zero-volatile organic compound ("VOC") paints. This way of packaging and dispensing paint eliminates the need for water-soluble VOCs or anti-skinning agents, which are added to paints to prevent skin formation when the paint is exposed to the air while in an open tray or can. This invention also makes it easy for the user to deliver the paint directly onto the surface being painted such as the muntin of a window, pipe, or table top.

According to one aspect, this invention provides a device for dispensing contents from one or more pouches. The device comprises two plates that are adapted to be partially hinged. The plates are further adapted such that, when they are hinged, there is a gap between the plates and hinged regions thereof. One or more pouches can be positioned between the plates. The gap is adapted such that a user may position a portion of the one or more pouches through the gap. A valve assembly is provided to allow or impede the dispensing of material from the portion of the one or more pouches that protrudes through the gap. The user exerts a force upon the one or more pouches by squeezing the plates toward each other. A ratcheting element helps secure the one or more pouches and position of the plates and automatically adjusts to accommodate the force exerted.

In another aspect of the invention, a combination of a dispensing device and one or more pouches, each containing a pourable material, is provided. To dispense contents from a pouch, the user creates a spout/opening by removing a portion of each corner of each pouch that protrudes through the gap. The user closes off each spout by engaging the clamping edge of a valve assembly. The clamping edge is adapted to span the gap through which the corner of the one or more pouches protrudes. The dispensing rate is determined by the size of the spout, the squeezing force exerted by the plates on the one or more pouches, the movement of the ratcheting element as the force is exerted, and the viscosity of the material being dispensed. A spout can be as small as a pin hole or large enough to dispense a highly viscous liquid or perhaps a food product such as soup that might contain lumps of meat or vegetable. A packager or manufacturer might pre-print a cutting guide line on a pouch to indicate the optimal opening size for the contents. The user can dispense almost the entire contents from each pouch simply by folding and tucking the nearly empty portions toward the center of the pouch and squeezing the plates harder to dispel the last bit of contents.

A method of using the device to dispense, or heat and dispense, the contents of one or more pouches is also provided. The user can insert between the plates any combination of one or more heating elements, one or more insulating elements, and one or more pouches. This feature is useful for dispensing and serving a warm soup or reducing the viscosity of the material to be dispensed. By way of example, this invention can be used to dispense two component epoxy resins. Additionally, when at least two pouches are used together and they contain liquids of different viscosities, one way the user can control the relative flow rates is to selectively heat the pouch(es) that contains the more viscous liquid(s).

This dispensing device can hold one or more smaller pouches at the dispensing end without the pouch(es) directly contacting or being supported by the ratcheting element. This can be achieved by adapting any one or more of the surfaces of any plate, pouch, heating element, or insulating element to be non-slip. Alternatively, the user could temporarily bond a pouch to any one or more surfaces of any plate, heating element, insulating element, or other pouch. A non-slip elastic sheet, double-faced tape, a dab of adhesive, or any combination thereof could be used for such purposes.

The dispensing device can be positioned to rest on a shelf as a spout faces upwards, or the device can lie flat near the edge of a shelf as a spout overhangs the edge. For gravity-assisted dispensing, the device could be mounted to a wall with a spout facing downward, or the device could be hung from a stand by a pair of mounting holes on the back plate. Finally, the device could be hung from a belt, tool caddy, or other portable article by the valve assembly handle or a hook mounted or integral to one of the plates.

DETAILED DESCRIPTION OF THE INVENTION

Figure 1:
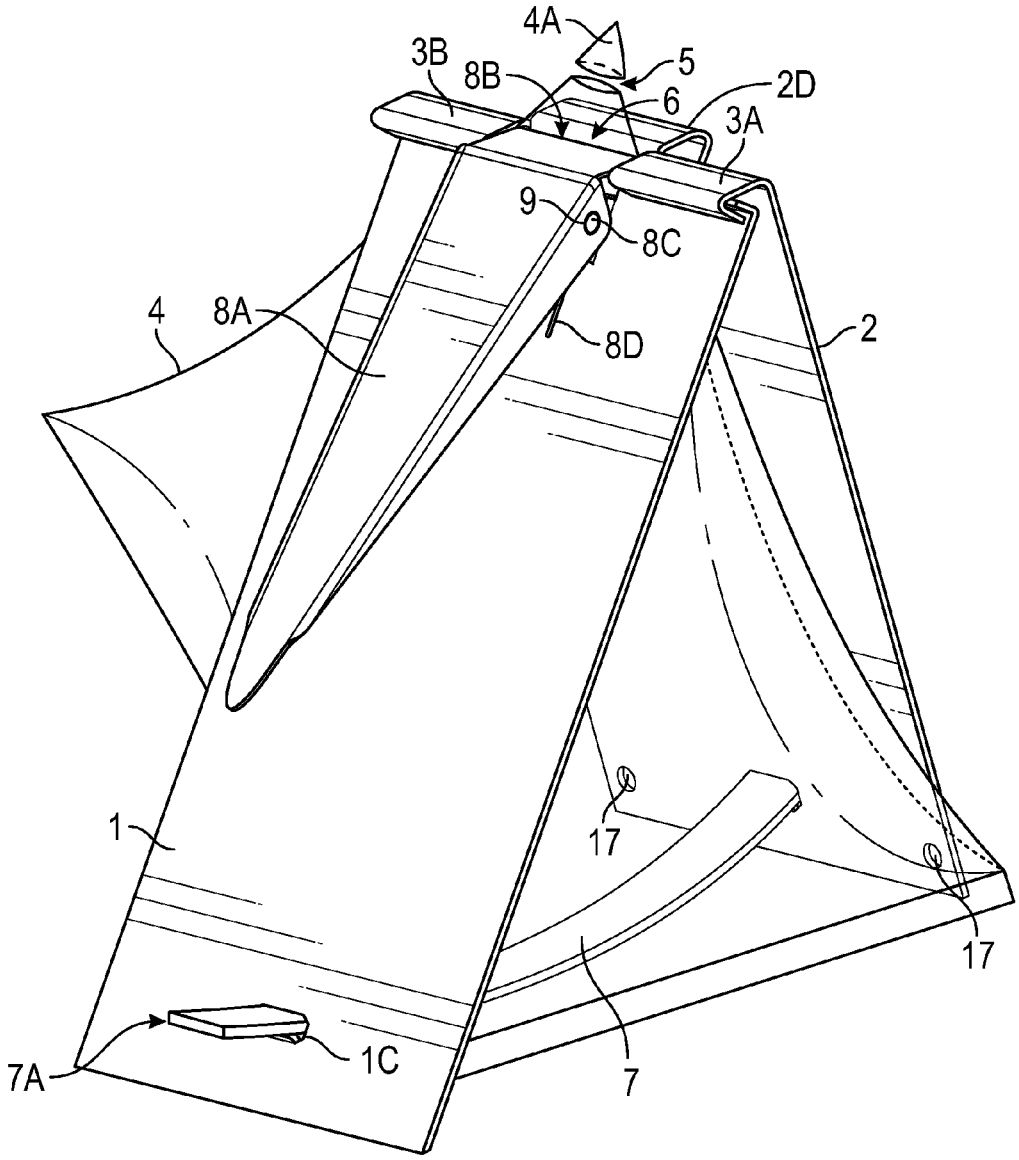
FIG. 1 is a perspective view of the dispensing device in combination with one flat pack pouch.

Particular terminology is used in the description below for convenience and to help guide the reader. The terminology is not limiting and includes the words actually used and any synonyms, derivatives, and terms of similar import. Likewise, the embodiments of the invention illustrated and described below are provided as examples only and are not intended to restrict the true spirit and scope of this invention as expressed in the claims. Terms that refer to orientation, such as "top" or "bottom," refer to the orientation of the features of the invention as they appear on the drawing page. When used to refer to a surface of a plate, the term "outer" refers to the surface that will not be in contact with a pouch, heating element, insulating element, or combination thereof. The term "inner" refers to the surface of the plate that is adapted to contact a pouch, heating element, or insulating element.

In the embodiment of FIG. 1, the top edge of a rectangular plate 1 and top edge of a second rectangular plate 2 are partially hinged at regions 3A and 3B. Plates 1 and 2 hold one pouch 4 diagonally between them. Preferably, the pouch 4 is a flat pack pouch. The top corner 4A of the pouch 4 protrudes through a gap 6 that is between the plates and regions 3A and 3B. The protruding corner 4A of a pouch becomes a spout 5 when the corner 4A is removed. A semi-rigid ratcheting element 7 with its free end 7A spans between the plates 1 and 2. The ratcheting element 7 holds up the folded lower corner (not shown) of the pouch 4.

The free end 7A of the ratcheting element 7 slides through the opening 1C to protrude from the outer surface of the plate 1. The ratcheting element 7 is anchored at 2C near the bottom edge of the plate 2. The opening 1C and the surface of the ratcheting element 7 are notched (as shown) or otherwise adapted such that the ratcheting element 7 can reversibly and repeatedly engage and disengage with the plate 1. The free end 7A of the ratcheting element 7 is loosened from and releases the plate 1 when the user lifts the free end 7A up toward of the top edges of the plates 1 and 2. The user can control the rate of dispensing by squeezing together the plates 1 and 2 until they, in turn, exert the desired force on the pouch 4.

The spout 5 is normally closed off tight with a valve assembly, preferably a pinch valve assembly. The pinch valve assembly shown comprises a tapered handle 8A that can also be used to hang the dispenser. The valve assembly further comprises a clamping edge 8B that spans the gap 6 and a pivoting pin 8C. The user controls the position of the clamping edge by pressing or releasing the handle 8A. Additional details of the valve assembly are provided in FIG. 5. To prevent damage to the spout 5 from repeated clamping, a protective elastic piece of split tubing 8E covers the clamping edge 8B. A pair of mounting holes 17 may be added to one or both of the plates.

To remove an empty pouch, the user lifts up the free end 7A of the ratcheting element 7 toward the hinged ends of the plates 1 and 2 such that the ratcheting element 7 disengages from the notched opening 1C. The user then pulls the ratcheting element 7 backward through the opening 1C until the ratcheting element 7 is no longer contacts the plate 1. The user can then separate the plate 1 from the plate 2 by swinging the bottom edge of the plate 1 away from the plate 2 and upward until the plate 1 is at least perpendicular to the ground. Once the empty pouch is removed, the user holds the new pouch by one corner, places a different corner through the gap 6, opens the clamping edge 8B of the valve assembly by pressing down the handle 8A, then hinges the plates back together. Lastly, the user feeds the free end 7A of ratcheting element 7 through the opening 1C.

Figure 2:
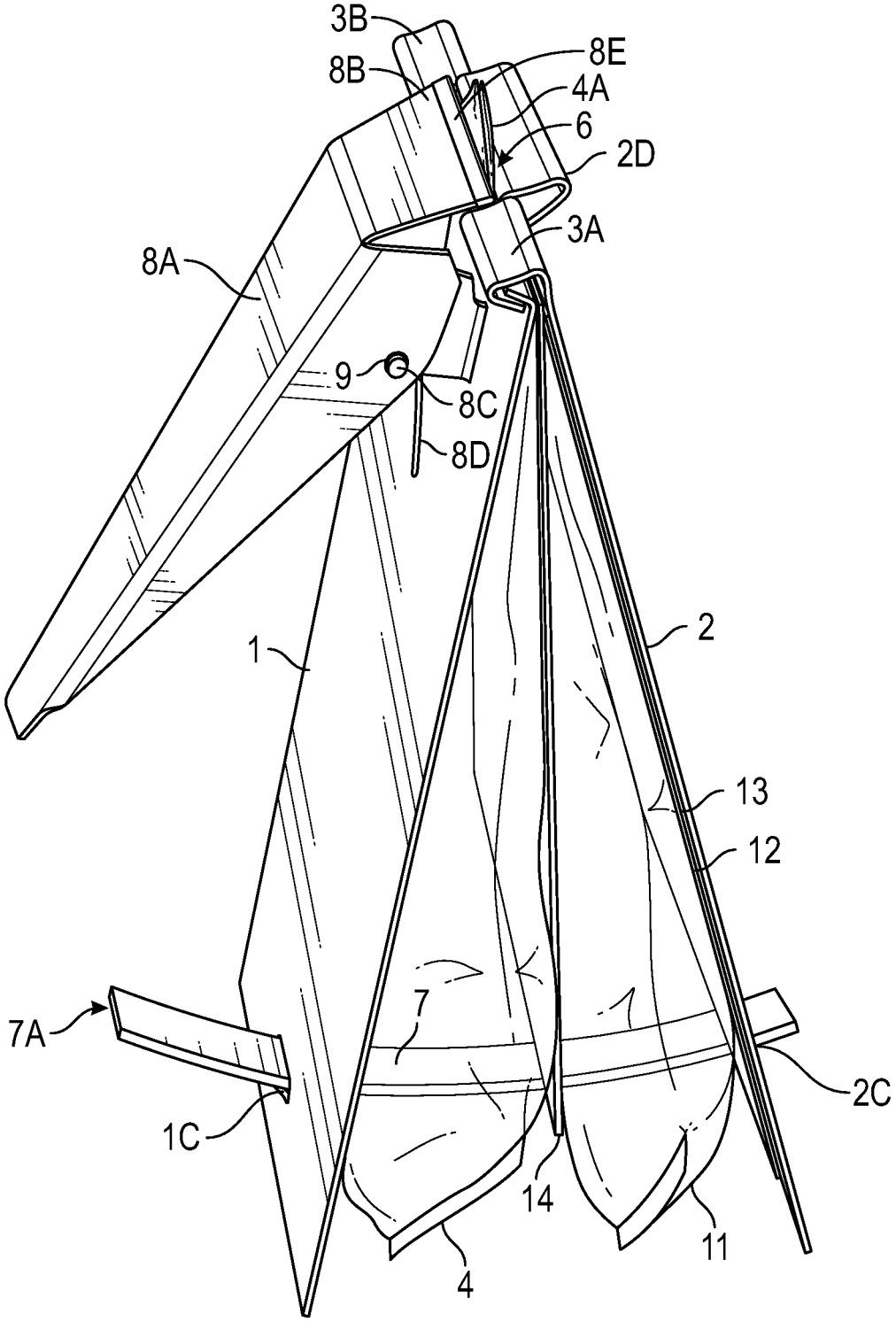
FIG. 2 is a perspective view of the dispensing device in combination with two flat pack pouches, a heating element, and two insulating elements.

In the embodiment of FIG. 2, the dispensing device of FIG. 1 is shown in combination with two pouches 4 and 11, a heating element 12, and two insulating elements 13 and 14. The pouch 11 is being heated by a rectangular heating element 12. One insulating element 13 is adjacent to the plate 2 while a second insulating element 14 insulates pouch 11 to help prevent heat from being transferred from pouch 11 to pouch 4. A section of the plate 2D could be bent to form a feature that could be used for hanging the device.

During prototyping, the pouch 4 was constructed from a bi-axially blown thermoplastic tube whose two open ends were bonded together with heat-sealed seams. Sealing the pouch in such a manner creates two acute or four right-angled corners. A pouch featuring one or more re-sealable sides can also be used. For example, a re-sealable sandwich or snack bag can be used. The dispensing device can accommodate a pouch of any polygonal shape; however, a rectangular pouch with an aspect ratio of close to one (a square) is preferred because it will provide the longest spout and hold the most volume. For the initial prototyping and tests with paint, a three mil square pouch with a capacity of sixteen to twenty fluid ounces was selected.

For multi-pouch applications, it is preferred that the pouches be substantially the same size and constructed of substantially the same material. The user might find it desirable to use pouches that are partially-filled, have lower capacities than a pouch that would be used for single-pouch dispensing, or some combination thereof.

Figure 2A:
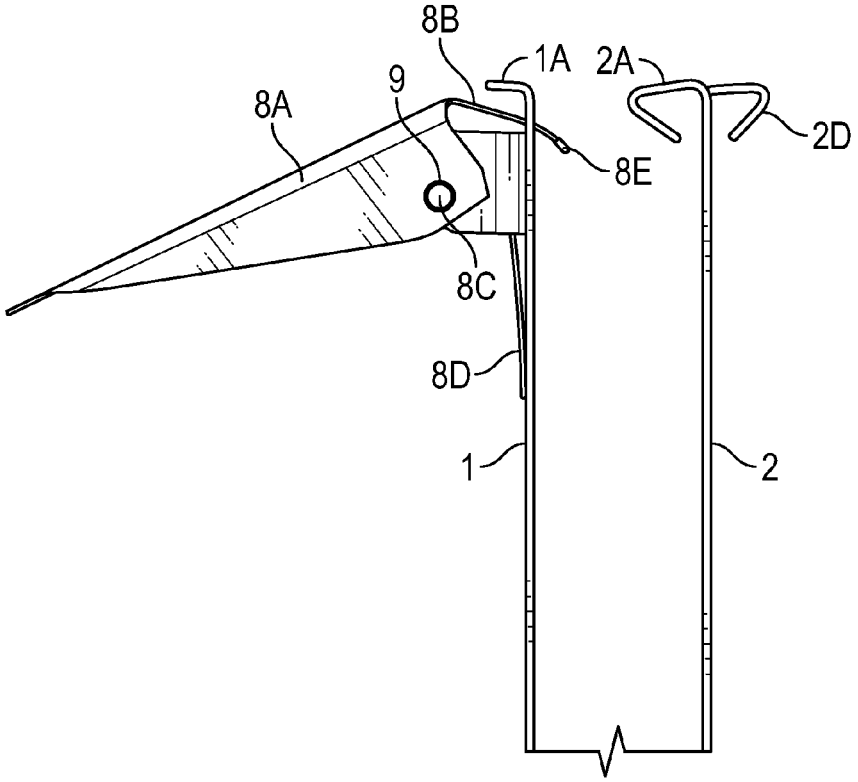
FIG. 2A is a cross-sectional view of the bent sections of the plates of the dispensing device.
Figure 2B:
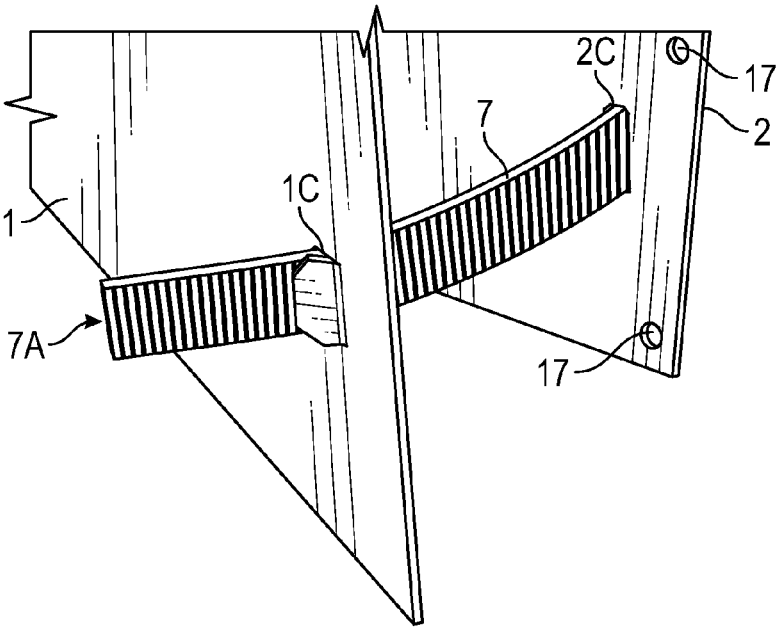
FIG. 2B is a view of the surface of the ratcheting element as it is engaged with the plates of the dispensing device.

As best shown in FIG. 2, the plates 1 and 2 are hinged at the regions 3A and 3B. The regions 3A and 3B are separated by the gap 6. Preferably, the plates 1 and 2 are reversibly hinged, preferably by hinging together bent sections of the plate 1 to bent sections of the plate 2. At region 3A, bent section 1A of plate 1 is hinged to bent section 2A of plate 2. Sections of plates 1 and 2 that are configured identically to 1A and 2A are hinged to form region 3B. Sections 1A and 2A are shown in detail in FIG. 2A. The bends are designed to stiffen the upper parts of the plates directionally and structurally and to provide more reliable hinging and clamping of the clamping edge 8B of a valve assembly. Although the plates were made of aluminum during prototyping, a person of ordinary skill in the art will recognize that they may be made of a different metal, a synthetic or semi-synthetic moldable polymer, or other material according to application for which the device is being used.

Figure 3:
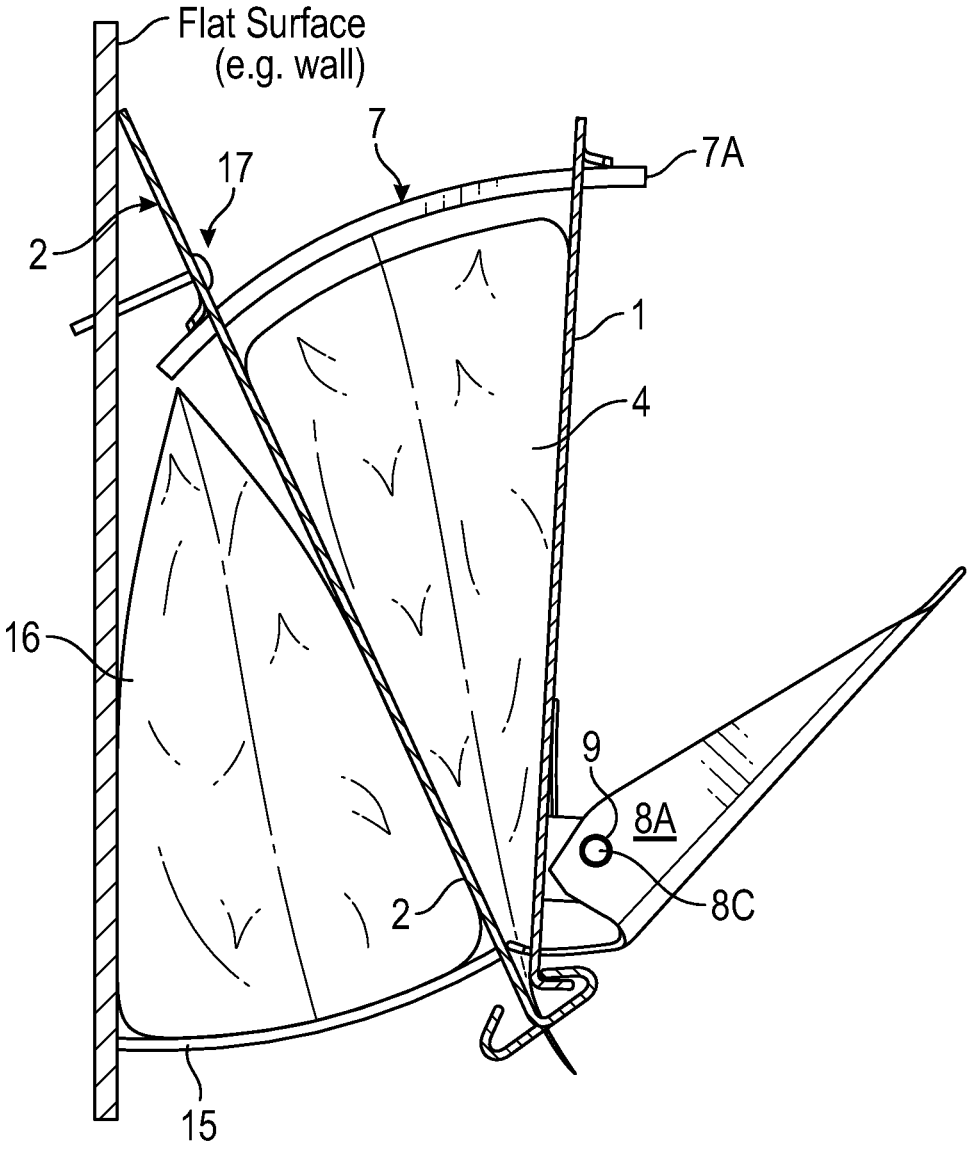
FIG. 3 is a cross-sectional view of the dispensing device in combination with one flat pack pouch. The combination is mounted against a flat surface as a spacer positions the dispensing device away from the surface and holds a spare pouch.

In the embodiment of FIG. 3, a combination of the dispensing device and a single pouch 4 is mounted on a wall for stationary, gravity-assisted dispensing. A spacer 15 keeps the spout away from the wall and holds a spare pouch 16. The spacer may assume any number of configurations. For example, the spacer could comprise an L-shaped plate mountable to a flat surface, e.g. wall, with mounting holes adapted to be secured by the same fastener that penetrates the mounting holes 17 to secure the back plate 2 to the wall. A spare pouch might rest on the portion of the spacer 15 that protrudes from the wall and contacts the back plate 2.

Figure 4:
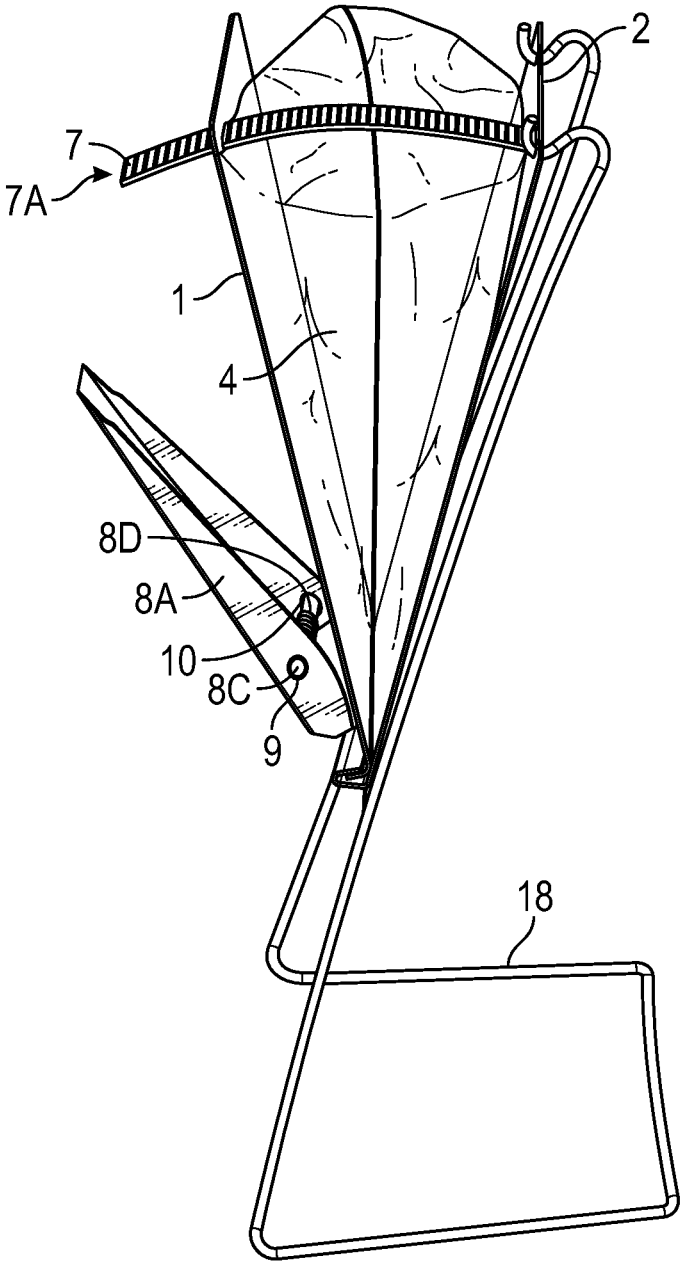
FIG. 4 is a perspective view of the dispensing device in combination with one flat pack pouch, as the device is hung from a table-top stand.

As shown in FIG. 4, a table-top wire stand 18 is used to hang a combination of the dispensing device and a single pouch 4 by the mounting holes 17.

Figure 5:
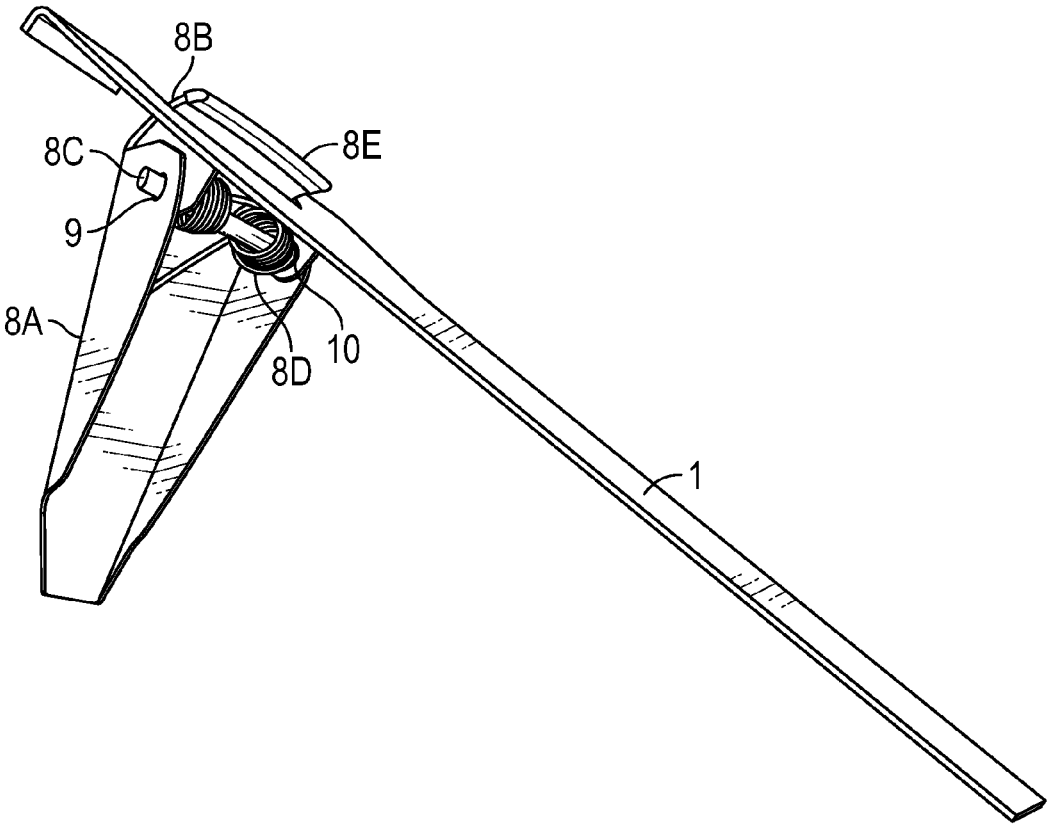
FIG. 5 is a perspective view of plate 1, showing features of the valve assembly.

As shown in FIG. 5, the pivoting pin 8C of the valve assembly supports a double torsion spring 8D. The valve handle 8A and the spring 8C are movably mounted to the plate 1 by the pin 8C through two pairs of identical pivoting holes 9 and 10. The outside pair of holes 9 are bored through the valve assembly handle 8A. The inside pair of holes 10 are bored through plate 1. The pivoting pin 8C and spring 8D were made of stainless steel during prototyping. A person of ordinary skill in the art will recognize that the components of the valve assembly may be constructed of other materials according to the application for which the device is being used.

SEQUENCE LISTING

Not Applicable

I claim:

1. In combination, a device for dispensing the contents of one or more pouches, and one or more pouches containing pourable discrete solid particles, a liquid, or mixture thereof, the device comprising:

two plates adapted to be partially hinged such that when the plates are hinged, there exists a gap between the plates and hinged regions thereof;

a valve assembly comprising a clamping edge adapted to span the gap between the plates and hinged regions thereof, wherein the valve assembly is connected to or integral to either of the plates, or wherein the valve assembly is in part connected to or integral to one of the plates and in part connected to or integral to the other plate;

a ratcheting element engaged with the plates such that when a force is exerted on the plates, the element adjusts to accommodate the force exerted and maintains its position and the position of the plates until an additional force, if any, is applied to the plates; and one or more heating elements positioned between the plates;

the one or more pouches each comprising one or more acute or right-angled corners.

2. The combination of claim 1, wherein the gap is adapted to allow a portion of the one or more pouches to protrude through said gap.

3. The combination of claim 1, wherein the clamping edge of the valve assembly is adapted to be reversibly engaged with one or both of the plates to impede or allow the dispensing of contents from one or more pouches.

4. The combination of claim 1, wherein the device further comprises one or more insulating elements positioned between the plates.

5. The combination of claim 4, wherein the gap is adapted to allow a portion of the one or more pouches to protrude through said gap.

6. The combination of claim 4, wherein the clamping edge of the valve assembly is adapted to be reversibly engaged with one or both of the plates to impede or allow the dispensing of contents from one or more pouches.

7. A method of dispensing contents from one or more pouches containing pourable discrete solid particles, a liquid, or mixture thereof, each pouch comprising one or more acute or right-angled corners, the method comprising:

positioning one or more pouches adjacent to at least one of two plates of a dispensing device such that a portion comprising an acute or right-angled corner of each of the one or more pouches protrudes through, or will protrude through, a gap between the two plates and hinged regions thereof when the plates are hinged;

wherein the dispensing device comprises:

two plates adapted to be partially hinged such that when the plates are hinged, there exists a gap between the plates and hinged regions thereof;

a valve assembly comprising a clamping edge adapted to span the gap between the plates and hinged regions thereof, wherein the valve assembly is connected to or integral to either of the plates, or wherein the valve assembly is in part connected to or integral to one of the plates and in part connected to or integral to the other plate; and a ratcheting element adapted to be engaged with the plates of the dispensing device;

hinging the plates of the dispensing device;

removing a portion of the corner of each of the one or more pouches that protrudes through the gap between the plates of the dispensing device and hinged regions thereof, thereby forming an opening in each such pouch;

either positioning one or more heating elements between the plates of the device and using the one or more heating elements to heat the contents of the one or more pouches, or positioning one or more insulating elements between the plates of the device;

positioning the clamping edge of the valve assembly in the desired position; and causing the contents of one or more pouches to be expelled by exerting a force on the plates of the dispensing device such that the force exerted on the plates is exerted on the one or more pouches.

8. The method of claim 7, further comprising engaging the ratcheting element to contact the plates of the device such that when a force is exerted on the plates, the element will adjust to accommodate the force exerted and maintain its position and the position of the plates until an additional force, if any, is applied to the plates.

9. The method of claim 7, further comprising positioning one or more heating elements between the plates of the device and using the one or more heating elements to heat the contents of the one or more pouches, and positioning one or more insulating elements between the plates of the device.

10. The method of claim 9, further comprising engaging the ratcheting element to contact the plates of the device such that when a force is exerted on the plates, the element will adjust to accommodate the force exerted and maintain its position and the position of the plates until an additional force, if any, is applied to the plates.

11. In combination, a device for dispensing the contents of one or more pouches, and one or more pouches containing pourable discrete solid particles, a liquid, or mixture thereof, the device comprising:

two plates adapted to be partially hinged such that when the plates are hinged, there exists a gap between the plates and hinged regions thereof;

a valve assembly comprising a clamping edge adapted to span the gap between the plates and hinged regions thereof, wherein the valve assembly is connected to or integral to either of the plates, or wherein the valve assembly is in part connected to or integral to one of the plates and in part connected to or integral to the other plate;

a ratcheting element engaged with the plates such that when a force is exerted on the plates, the element adjusts to accommodate the force exerted and maintains its position and the position of the plates until an additional force, if any, is applied to the plates; and one or more insulating elements positioned between the plates;

the one or more pouches each comprising one or more acute or right-angled corners.

12. The combination of claim 11, wherein the gap is adapted to allow a portion of the one or more pouches to protrude through said gap.

13. The combination of claim 11, wherein the clamping edge of the valve assembly is adapted to be reversibly engaged with one or both of the plates to impede or allow the dispensing of contents from one or more pouches.

* * * * *